United States Patent [19]

Scheible

[11] Patent Number: 5,058,734

[45] Date of Patent: Oct. 22, 1991

[54] STORAGE AND DISPLAY DEVICE FOR COIN CASSETTES

[76] Inventor: Wayne Scheible, 3800 Dewey Ave., Rochester, N.Y. 14616

[21] Appl. No.: 644,208

[22] Filed: Jan. 22, 1991

[51] Int. Cl.[5] ..... B65D 25/64; A45C 1/00

[52] U.S. Cl. ..... 206/0.83; 206/45.34

[58] Field of Search ..... 206/0.8, 0.81, 0.82, 206/0.83, 0.84

[56] References Cited

U.S. PATENT DOCUMENTS

| | | | |
|---|---|---|---|
| 2,258,535 | 10/1941 | Buranelli | 206/0.83 |
| 2,521,792 | 9/1950 | Hollander | 206/0.83 |
| 2,571,073 | 10/1951 | Stroop | 229/71 |
| 3,057,459 | 10/1962 | Burdick | 206/0.83 |
| 3,064,805 | 11/1962 | Bains | 206/0.83 |
| 3,193,090 | 7/1965 | Hudgeons, Sr. et al. | 206/0.83 |
| 3,500,995 | 3/1970 | Forman | 206/0.84 |
| 4,005,778 | 2/1977 | Vuille et al. | 206/0.84 |
| 4,385,688 | 5/1983 | Grant | 206/0.83 |
| 4,402,399 | 9/1983 | Friess | 206/0.83 |

FOREIGN PATENT DOCUMENTS

| | | | |
|---|---|---|---|
| 1094692 | 12/1954 | France | 206/0.83 |
| 1033714 | 6/1966 | United Kingdom | 206/0.83 |

*Primary Examiner*—William I. Price

*Attorney, Agent, or Firm*—Michael Ebert

[57] ABSTRACT

A storage and display device for a group of generally rectangular cassettes that vary somewhat in their sizes, each housing a coin whose head and tail are visible through opposite sides of the cassette. The device includes a board having elongated parallel wells formed therein dimensioned to accommodate the group of cassettes in side-by-side relation. A transparent backing behind the board defines the base of the wells, the coin tails being visible therethrough. Also provided are transparent film windows which resectively overlie the wells and are slidable along the board from an open position in which the wells may be loaded with cassettes to a closed position in which the cassettes are entrapped within the wells and the heads of the coins are then visible through the windows.

14 Claims, 3 Drawing Sheets

Fig. 1.
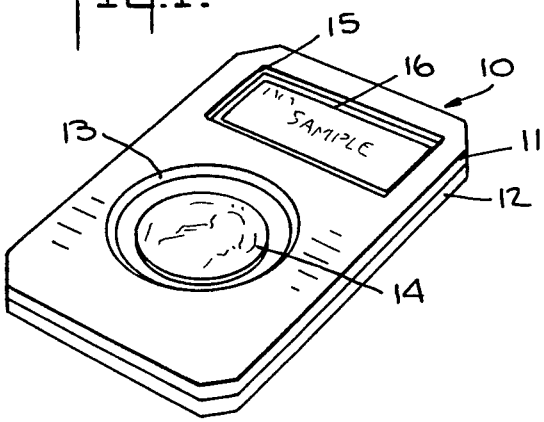
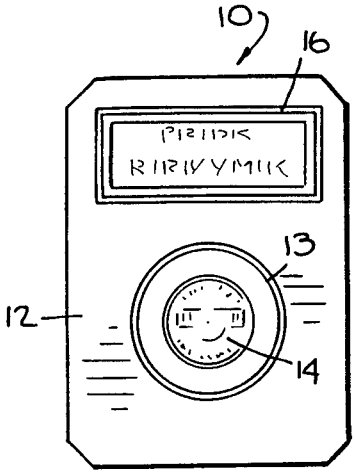
Fig. 2.
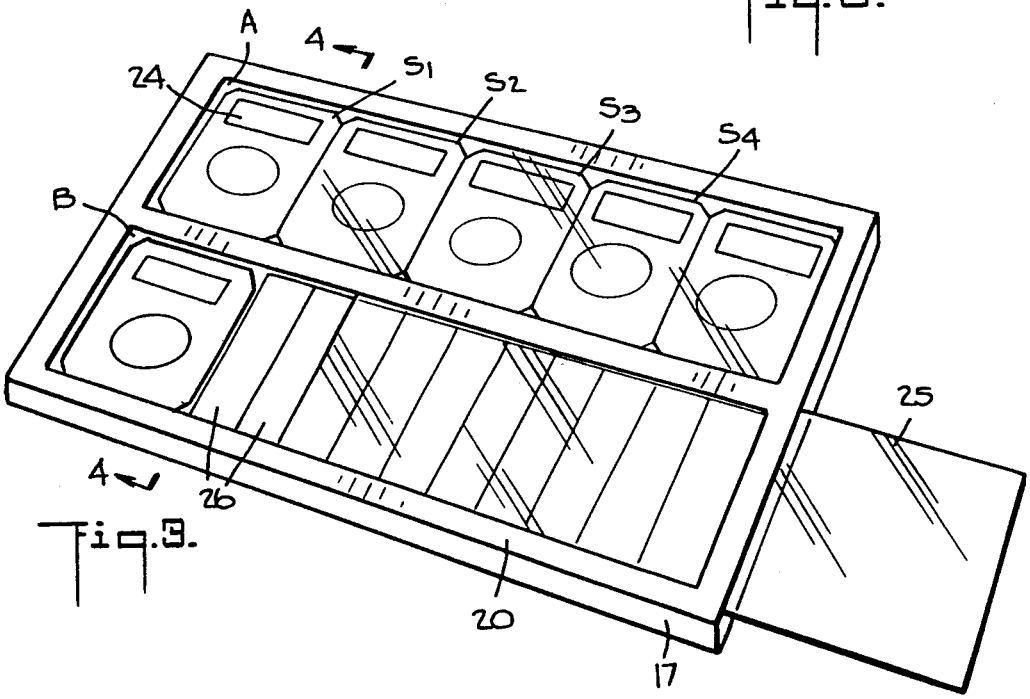
Fig. 3.
Fig. 4.
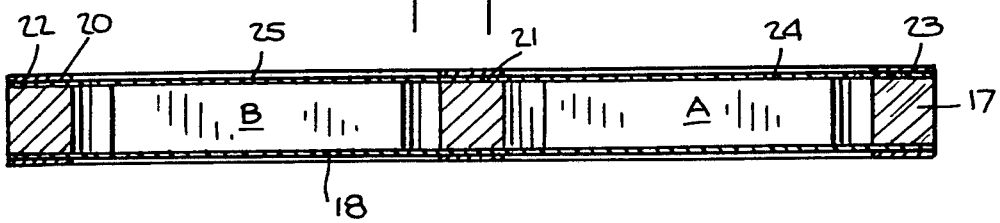

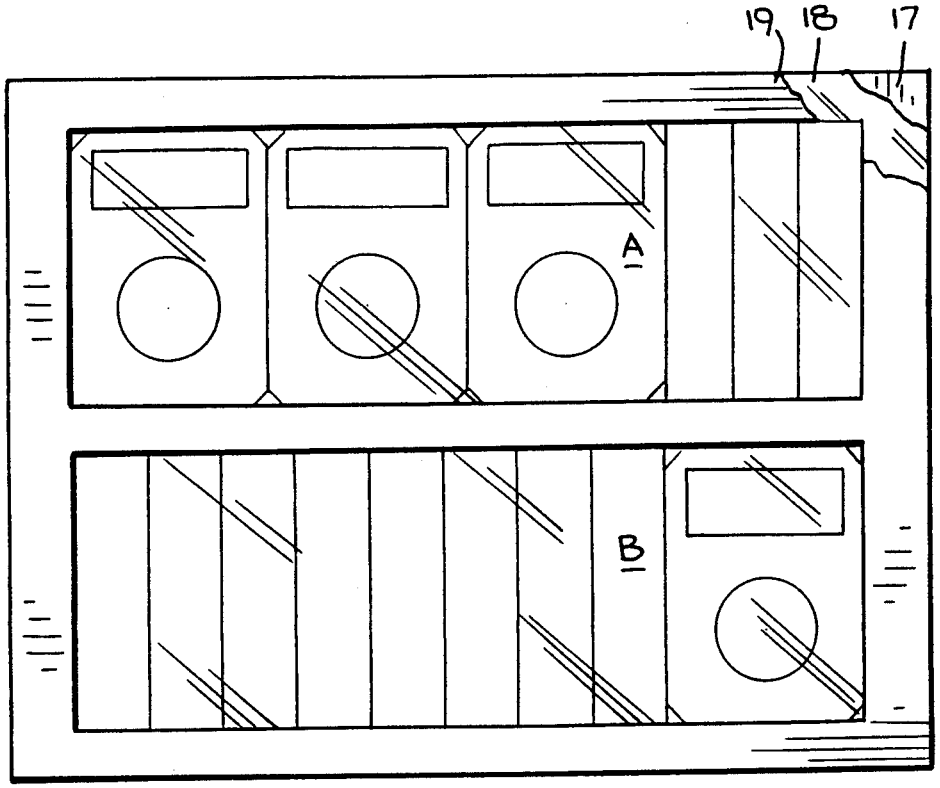
Fig. 5.
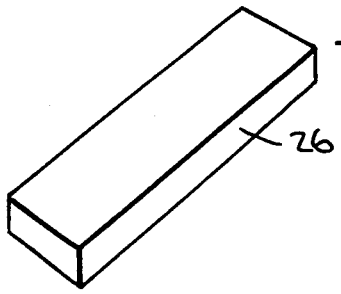
Fig. 6.
Fig. 7.
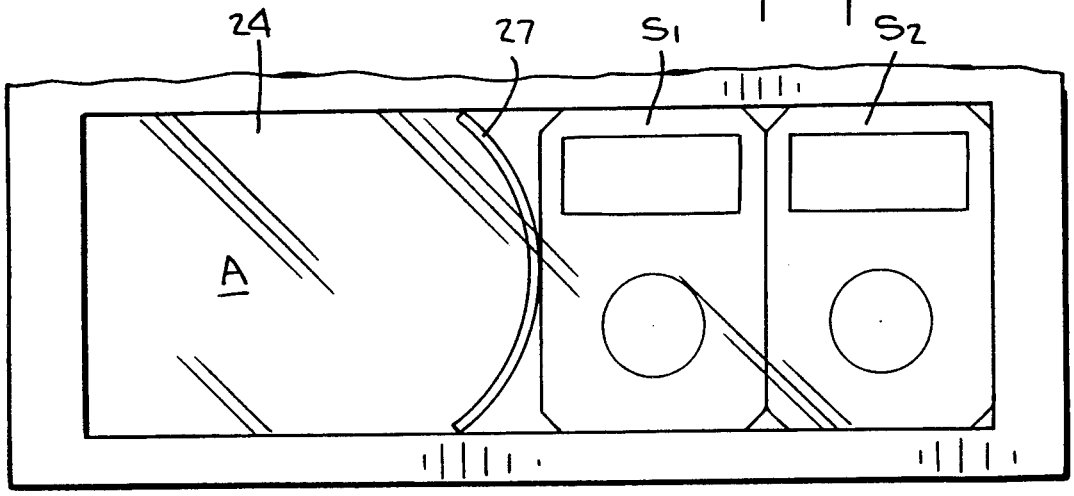

STORAGE AND DISPLAY DEVICE FOR COIN CASSETTES

BACKGROUND OF INVENTION

1. Field of Invention

This invention relates generally to devices for storing and displaying coins, medals and other valuable small objects, and more particularly to a device for storing and displaying transparent cassettes, each housing a coin or medal.

2. Status of Prior Art

Numismatics involves the study and collection of coins and medals as works of art as well as sources of historical information. Coins and medals preserve old forms of writing, portraits of eminent historical figures, and reproductions of lost works of art. Nusmismatists or coin collectors value coins and medals in accordance with their condition and rarity.

It is now a widespread practice for experts in the field of numismatics to certify coins or medals in respect to their character and condition. In a field in which counterfeiting is not uncommon, such certification assures a collector of the genuineness of his acquisition. Thus if a rare French coin made of gold is in a mint state (i.e., the coin if unmarred as if fresh from the mint), the expert so certifies by using the symbol MS. But if the coin is worn or eroded, this state is indicated.

Certification data affords dealers and collectors with necessary grading information regarding the age, character and condition of the coin certified and is an index to its value.

In recent years, certified coins and medals are often packaged in what are generally referred to as coin slabs. A coin slab is a sealed cassette molded of transparent, synthetic plastic material. The cassette is formed of complementary sections which define a circular recess to accommodate the certified coin and a rectangular recess in which a small certification card is seated. Printed on the front of this card is the certification data, the identity of the certifier being printed on the rear.

Thus when looking at the front face of the cassette one sees the head of the coin and the certifying data, and when looking at the reverse face one then sees the tail of the coin and the name of the certifier.

The cassette or coin slab not only provides a convenient package for the coin, but because it is sealed to render it air tight, the coin is not subject to tarnishing from airborne contaminants. And while with a coin slab one may examine the coin housed therein without the examiner's finger making contact with the coin. Because of reactive chemical agents in the pores of human skin, finger contact may result in coin corrosion.

The problem which is the concern of the present invention is in regard to storing and displaying certified coin cassettes or slabs. This is no problem when there is only a handful of slabs. But for collectors and coin dealers who have in their possession a considerable number of coin slabs, the usual practice of storing these slabs in containers and boxes does present a problem. Every time a need arises to examine a particular coin slab, one then has to remove all of the slabs from the boxes to search for the slab of interest.

Coin slabs are now so molded as to facilitate their stacking in open cases or on shelves. To this end, the slabs must be identical in form, each slab having a peripheral ridge on one side that can be socketed within a complementary ridge on the opposite side of the adjoining slab. But when slabs are stacked, their coins and certification cards are blocked from view. It is therefore often the practice to provide slabs with an edge strip having some certification data printed therein. These edge strips are viewable when the slabs are stacked.

While edge strips are helpful in selecting a particular coin slab from a stack, the coins housed in the stacked slabs cannot be seen. As a practical matter what a coin dealer or collector who has in his possession a considerable number of coin slabs has need of is some means of storing those coin slabs which would at the same time serve to display the coins and their certification cards. In this way, when the dealer or collector wishes to see what coin slabs he has in storage and to withdraw therefrom a particular slab, he can do so without having to run a slab-by-slab search.

To complicate the storage and display problem faced by a dealer or collector having a large number of certified coin slabs is the fact that no standardized slab size has been adopted by certifiers. Coin slabs now commercially available differ somewhat in their sizes. Thus one commercially-available coin slab is $3\frac{1}{4}$ inches in length, $2\frac{1}{2}$ inches in width and $\frac{3}{8}$ inches in thickness, while others are fractionally greater or smaller in length, width or thickness.

Known forms of storage and display devices for coins and medals are only adapted to accommodate holders therefor having identical sizes. Thus the Grant patent 4,425,997 discloses a display device for coin holders in which a coin is placed between a pair of transparent sheets sandwiched between a pair of identical plates having openings therein which expose the head and tail of the coin. The display device for these coin holders takes the form of an apertured board, each aperture socketing a respective coin holder. The display device is suitable for coin holders of identical size but is inappropriate for certified coin slabs that differ somewhat in their sizes. A similar storage and display device is disclosed in Grant patent 4,385,688.

In the coin display arrangement shown in the Deese patent 4,043,444, each coin is housed in a holder having interlocking elements at it edge which are captured by an adjacent holder, thereby making it possible to form a display array of interlocked coin holders. But here again, the coin holders must have identical sizes.

Also of background prior art interest in regard to coffers and other holders for storing and displaying numismatical coins and medals are the patents to Vuille, 4,005,778; to Bains, 3,064,805; to Stroop, 2,571,073; to Friess, 4,402,399; to Hudgeons, Sr. et al., 3,193,090; and to Hollander, 2,521,792.

SUMMARY OF INVENTION

In view of the foregoing, the main object of this invention is to provide a storage and display device adapted to accommodate a group of certified coin cassettes or similar transparent packages for small objects, the cassettes having identical or somewhat varying sizes.

When used with certified coin cassettes, a device in accordance with the invention makes it possible to view both the head and tail of the coins as well as the certification card without having to remove the cassette from the storage and display device.

More specifically, an object of the invention is to provide a device for accommodating a group of certified coin slabs, the device including at least one well adapted to receive the slabs in side-by-side relation, the well having a transparent base and a front window whereby both sides of the coin slabs may be examined.

A significant advantage of the invention is that it lends itself to different formats, one being an album in which the device is provided with covers which may carry identifying data. In another format, the device slips into a transparent storage pocket or sleeve for shelf storage, and in another, the device is provided with mounting lugs so that it may be hung on a wall.

Also an object of the invention is to provide a device for storing and displaying coin cassettes in which the wells of the device may be partially loaded, yet the cassettes are not free to shift therein.

Still another object of the invention is to provide an inexpensive storage and display device of the above type which is of relatively simple design and can be mass-produced at low cost.

Briefly stated, these objects are attained in a storage and display device for a group of generally rectangular cassettes that vary somewhat in their sizes, each housing a coin whose head and tail are visible through opposite sides of the cassette. The device includes a board having elongated parallel wells formed therein dimensioned to accommodate the group of cassettes in side-by-side relation. A transparent backing behind the board defines the base of the wells, the coin tails being visible therethrough. Also provided are transparent film windows which respectively overlie the wells and are slidable along the board from an open position in which the wells may be loaded with cassettes to a closed position in which the cassettes are entrapped within the wells and the heads of the coins are then visible through the windows.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a conventional certified coin cassette as seen from its front;

FIG. 2 is a rear view of the cassette;

FIG. 3 shows, in perspective, a storage and display device in accordance with the invention partially loaded with coin cassettes, one front window being partially withdrawn;

FIG. 4 is a transverse section taken through the plane indicated by line 4—4 in FIG. 3;

FIG. 5 is a rear view of the device;

FIG. 6 shows one of the filler pieces used in the device to fill in unoccupied space;

FIG. 7 shows one well in the device partially occupied by cassettes, and a bowed stop element to prevent the cassettes from shifting;

DESCRIPTION OF INVENTION

Conventional Coin Slab

Figure 8:
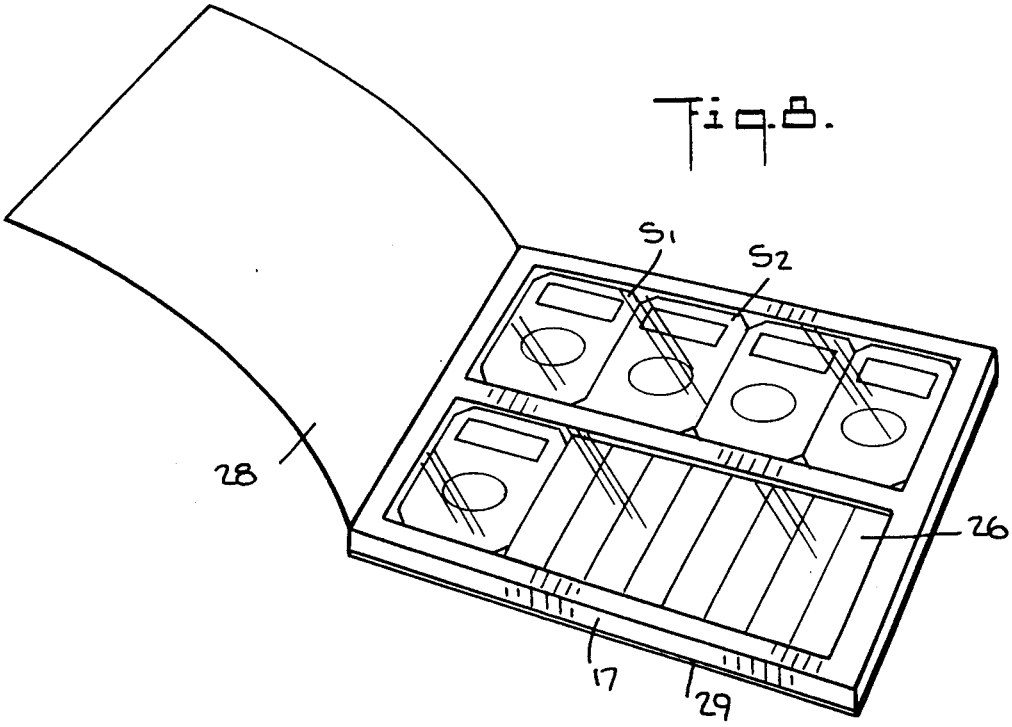
FIG. 8 shows the device in an album format.

Referring now to FIGS. 1 and 2, there is shown one form of a conventional certified coin cassette or coin slab 10. It is molded of transparent, synthetic plastic material such as acrylic of polycarbonate, the cassette being constituted by complementary upper and lower sections 11 and 12 which are generally rectangular. After the coin to be housed and the certification card are sandwiched between the sections, the sections are sealed together to render the cassette airtight. In this way, the card is entrapped and the coin is isolated from contaminants in the air that may act to tarnish the coin.

Seated within a circular recess 13 in the cassette is a numismatic coin 14, such as a 1904 U.S. silver dollar, the head of the coin being exposed at the front face of the cassette and the tail at the rear face thereof. Thus one may clearly view both sides of the coin without touching it.

Seated within a generally rectangular recess 15 in the cassette is a small paper card 16 on whose front is printed certification data, such as 1904 silver dollar, MS (mint state), and other information relevant to the character of the coin. Printed on the rear of the card and visible through the rear side of the cassette is the name of the certifier.

As pointed out previously, a certification coin slab makes it possible to handle and view the numismatic coin without touching it, and it protects the coin against dirt and corrosion.

It is to be understood, however, that the invention which resides in a storage and display device for a group of coin slabs or cassettes is not limited to numismatic coins, for the same device is usable for cassettes which contain medals, tokens or other valuable objects such as rare baseball cards. These baseball cards and certification data give information regarding the publication date of the card, the baseball team of which the player illustrated was a member and other pertinent data could be housed in the same cassette. Also, the transparent cassettes could be used to house rare gem stones and certification data therefor.

Storage and Display Device

As shown in FIGS. 3 to 5, a storage and display device in accordance with the invention includes a rectangular board 17. This board may be made of wood, dense foam plastic material, multi-ply cardboard or any other suitable rigid material.

Die cut or otherwise formed in board 17 are two elongated rectangular wells A and B in parallel relation. The wells are identical and their dimensions are such that each well can accommodate a series of coin slabs, such as slabs $S_1$ to $S_4$ in side-by-side relation. The well dimensions are such that each well will admit within its confines the largest size of existing types of coin slabs in terms of length, width and thickness, as well as those having somewhat smaller sizes. Hence the device is adapted to accommodate the full range of commercially-available coin slab sizes.

Marginally bonded to the rear surface of board 17 is a sheet 18 of transparent film material having high clarity, such as polyvinyl chloride or polyester, the sheet serving as the transparent base of the wells. And, as best seen in FIG. 5, laminated to transparent sheet 18 is a rear cardboard frame 19 having openings therein which register with wells A and B in the board.

The device is provided with a front cardboard frame 20 having the same configuration as the rear frame and including openings which register with wells A and B. Laminated between front frame 20 and board 17 is a center spacer strip 21 and lower and upper edge spacer strips 22 and 23 which run the full length of the board. These spacers in conjunction with upper frame 20 create slideways which overlie wells A and B to receive windows 24 and 25. These windows are formed of flexible, plastic transparent film material such as MYLAR polyester film or other scratch resistant material having high clarity.

In practice, the storage and display device may not be fully loaded with coin cassettes. In order, therefore, to prevent the cassettes in a partially loaded device from shifting in the wells, the unoccupied space is filled by slab-shaped filler pieces, such as piece 26 shown separately in FIG. 6. The length of these pieces and their thickness match the width and height of the wells so that they fit snugly therein. Each piece has, for example, a one-inch width. Hence if the vacant space in a well is two inches, one then inserts two filler pieces to occupy this space.

Windows 24 and 25 have the same length as that of board 17 and are slidable in their respective slideways from a closed position in which the windows serve to entrap the cassettes in their wells, to an open position providing access to the wells to permit loading or withdrawal of the cassettes.

When the windows are closed, the front of the cassettes entrapped within the device are viewable through the windows and the viewer can then see the head of the coins and the certification data on the cards. He can also view the tails of the coins through the rear transparent sheet on the opposite side of the device.

The dimensions of the wells determine the cassette capacity of the device, and in practice a well having a $3\frac{3}{8}$ by 10 inch size can accommodate four typical certified coin cassettes. If, therefore, there are two wells, the device will have an eight cassette capacity. However, the invention is not limited to a device having two parallel wells and a larger board may be provided with a greater number of wells.

In lieu of spacer pieces, a stop element 27 may be provided, as shown in FIG. 7, in conjunction with cassettes $S_1$ and $S_2$ loaded in well A at the right side thereof, thereby leaving a large unoccupied space in the well. Stop element 27 takes the form of a flexible plastic or metal strip whose length is greater than the width of the well. By flexing element 27 to create a bow whose ends engage the side walls of well A and by pressing the peak of the bow against the side of cassette $S_1$, the bow which because of its memory seeks to straighten out, remains in place in the well and prevents shifting of the cassettes.

Formats

A storage display device D in accordance with the invention, as shown in FIG. 7, may be put in a book or album format by providing a cover therefor. This cover includes front and rear flaps 28 and 29 having the same dimensions as the board, the spine of the cover being bonded to the left edge of board 17.

One advantage of this format is that it permits classification and identification of the storage and display device. Thus if a particular device stores certified coin cassettes in which all of the coins are ancient Roman coins, this can be indicated on the cover of the album. In this way, a dealer or collector may store a large collection of certified coin slabs in classified albums, and place these albums in a book case for ready reference.

Figure 9:
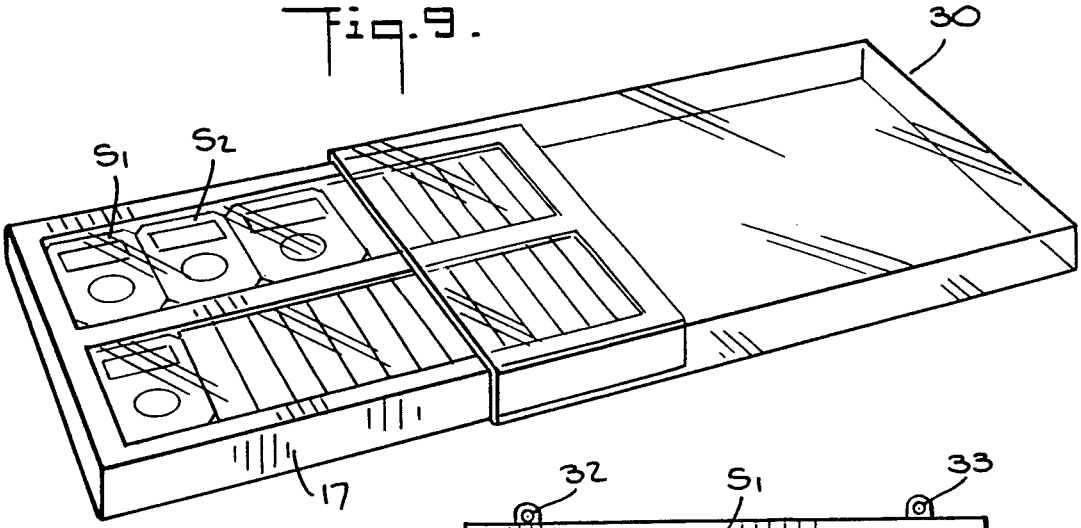
FIG. 9 shows a protective sleeve for the device.

An alternative to the album format is that shown in FIG. 9, in which the storage and display device slips snugly into a protective pocket or sleeve 30 which may be fabricated of heavy-duty, transparent plastic film material. Attached to the edge of the sleeve is a label 31 on which identifying data may be entered. Thus one may place a bank of ensleeved storage and display devices on a shelf for ready reference.

Figure 10:
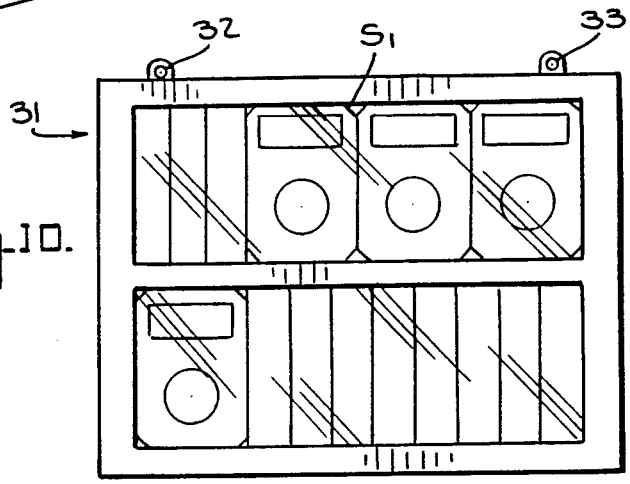
FIG. 10 shows the device in a wall hanging format.

In some instances, the collector or dealer who wishes to exhibit his certified coin cassettes by mounting the storage and display device on a wall can do so by a device 31, as shown in FIG. 10, having mounting lugs 32 and 33 attached to the upper edge of the device. These lugs are provided with holes so that the device can be wall mounted by wall anchor pins going through the lug holes.

While there have been shown and described preferred embodiments of a storage and display device for coin cassettes in accordance with the invention, it will be appreciated that many changes and modifications may be made therein without, however, departing from the essential spirit thereof.

Thus the board having wells and a transparent backing for the wells may be molded as a single piece of a transparent plastic such as acrylic, the plastic board having slideways formed therein to receive transparent windows for covering the wells. Or instead of windows, use may be made of a transparent panel that fits over the top face of the board and is latchable thereto by snap fasteners or other detachable latching means.

I claim:

1. A storage and display device for a group of generally rectangular transparent cassettes that may vary somewhat in their sizes, each cassette housing a coin or medal whose head and tail are visible through opposite sides of the cassette, said device comprising:

(a) a board having elongated parallel wells formed therein dimensioned to accommodate the group of cassettes in side-by-side relation therein, said board having a transparent backing to define the base of the wells, the tails of the coins in the cassettes being visible through the backing; and (b) transparent windows overlying the respective wells and slidable on the board from an open position in which cassettes may be loaded in the wells or withdrawn therefrom to a close position in which the cassettes loaded in the wells are entrapped therein to a closed position in which the heads of the coins are visible through the windows.

2. A device as set forth in claim 1, wherein said board is made of dense foam plastic material.

3. A device as set forth in claim 1, in which the board is made of wood.

4. A device as set forth in claim 1, wherein the board is provided with front and rear frames each having openings in registration with the wells.

5. A device as set forth in claim 4, wherein said backing is a sheet of transparent material which is sandwiched between the rear frame and the board.

6. A device as set forth in claim 4, wherein said front frame is joined to said board by spacers which define slideways for said windows.

7. A device as set forth in claim 1, wherein said windows are formed of transparent, flexible, synthetic plastic film material of high clarity.

8. A device as set forth in claim 1, provided with a cover to create an album.

9. A device as set forth in claim 1, further including a protective pocket of transparent, plastic film material adapted to accommodate the device.

10. A device as set forth in claim 9, in which a label is attached to an edge of the pocket to identify the device.

11. A device as set forth in claim 1, having mounting lugs attached thereto, making it possible to hang the device from a wall.

12. A device as set forth in claim 1, provided with filler pieces which are insertable into said wells to fill spaces therein not occupied by cassettes to prevent shifting of the cassettes in the wells.

13. A device as set forth in claim 12, in which each filler piece is formed of a slab whose length and thickness substantially matches the width and depth of the well.

14. A device as set forth in claim 1, further including a stop element formed of a flexible strip whose length is greater than the width of a well, the strip being bowable to fit into the well against a cassette loaded therein.

* * * * *